US007578683B2

(12) United States Patent
Zijlstra

(10) Patent No.: US 7,578,683 B2
(45) Date of Patent: Aug. 25, 2009

(54) PLUG WITH SLIDABLE PINS AND BLOCKING DEVICE

(76) Inventor: Eduard Mathieu Antonius Zijlstra, 60 Benzenraderweg, Heerlen (NL) 6417 ST ( * ) Notice: Subject to any disclaimer, the term of this patent is extended or adjusted under 35 U.S.C. 154(b) by 0 days.

(21) Appl. No.: 11/994,620

(22) PCT Filed: Jul. 5, 2006

(86) PCT No.: PCT/NL2006/000337

§ 371 (c)(1),
(2), (4) Date: Jan. 3, 2008

(87) PCT Pub. No.: WO2007/008061

PCT Pub. Date: Jan. 18, 2007

(65) Prior Publication Data

US 2008/0227330 A1 Sep. 18, 2008

(30) Foreign Application Priority Data

Jul. 8, 2005 (NL) ..... 1029478
Mar. 23, 2006 (NL) ..... 1031429

(51) Int. Cl.
*H01R 13/44* (2006.01)

(52) U.S. Cl. ..... 439/131

(58) Field of Classification Search ..... 439/131, 439/133, 171–174
See application file for complete search history.

(56) References Cited

U.S. PATENT DOCUMENTS 4,626,052 A * 12/1986 Rumble ..... 439/173
5,159,545 A * 10/1992 Lee ..... 363/146
5,423,690 A * 6/1995 Selker et al. ..... 439/172
5,791,921 A 8/1998 Lee
6,025,486 A * 2/2000 Mistry et al. ..... 540/122
6,062,884 A * 5/2000 Messimer et al. ..... 439/172
6,190,184 B1 * 2/2001 Cimbal et al. ..... 439/131
6,382,996 B1 * 5/2002 Eyman ..... 439/172
6,923,666 B1 * 8/2005 Liao ..... 439/172
7,052,298 B1 * 5/2006 Cheng ..... 439/171

FOREIGN PATENT DOCUMENTS

WO WO-02/063723 8/2002

OTHER PUBLICATIONS

International Search Report for PCT/NL2006/000337.

* cited by examiner

*Primary Examiner*—Alexander Gilman
(74) *Attorney, Agent, or Firm*—Foley Hoag LLP

(57) ABSTRACT

Plug, comprising a housing with a first contact face, a first set of pins for a first type of power point, and a first blocking device, comprising interacting first and second blocking means, in which the first set of pins is slidably accommodated in the housing. The first set of pins in the active position projects from the first contact face of the housing in such a way that said set of pins can be inserted into the first type of power point. The first blocking means are connected to the first set of pins. The second blocking means are connected to the housing. The first and second blocking means are movable relative to each other, so that they can assume a blocking position and an unblocking position.

The first blocking device furthermore comprises a first stopper, which first stopper is movable between a stop position, in which the movability of the first and second blocking means relative to each other is prevented, and a release position.

10 Claims, 13 Drawing Sheets

PLUG WITH SLIDABLE PINS AND BLOCKING DEVICE

CROSS-REFERENCE TO RELATED APPLICATION

This application is the National Stage of International Application no. PCT/NL2006/000337 filed Jul. 5, 2006, which claims the benefit of Netherlands application number 1029478 filed Jul. 8, 2005 and of Netherlands application no. 1031429 filed Mar. 23, 2006, the contents of which are incorporated by reference herein.

FIELD OF THE INVENTION

The invention relates to a plug with slidable pins and blocking device, according to the preamble of claim 1.

BACKGROUND OF THE INVENTION

WO-A2-02/063723 discloses a plug with a housing, out of which housing various sets of pins can be slid, each set being intended for a specific type of power point. The pins are slid out by means of levers which extend outside through separate slots in the housing. The levers and the pins of one type are in each case connected to each other inside the housing by a connecting part which is slidably accommodated in the housing.

The plug furthermore has a safety element. Said safety element is accommodated so as to be slidable laterally in the housing. Slidable laterally should be understood as meaning in a direction transversely to the sliding directions of the pins. The safety element is slid by means of a push button located on the outside of the housing.

The safety element comprises various retaining bars. Said retaining bars extend in the same direction as the pins. The retaining bars have a sloping sliding surface which merges by way of a straight sliding surface, i.e. a surface extending in the direction of the pins, into an opening. The connecting part of the pins is provided with sliding lugs. During the process of sliding out a set of pins by means of the lever, the sliding lugs slide along the sloping sliding surfaces of the retaining bars. Owing to the fact that the pins are fixed in the radial direction, this sliding along the sloping sliding surfaces results in the safety element sliding sideways. At the end of the retaining bars the sliding lugs reach the position of the corresponding openings of the retaining bars. Under spring force the sliding lugs fall into the openings, so that the safety element slides back and the safety element is locked with the pins.

A disadvantage of the known plug is that said plug can become less reliable in the long term as a result of wear. The projecting corners of the sliding lug and the opening can become worn and acquire, for example, a chamfered or rounded profile. The result is that the locking of the sliding lug in the opening becomes less reliable and the pins can be inadvertently pushed into the housing.

SUMMARY OF THE INVENTION

The invention aims to eliminate this disadvantage at least partially, or in any case to provide a usable alternative.

In particular, the invention aims to provide a more reliable locking system which can retain its reliability also in the longer term.

The invention achieves this aim by means of a plug according to claim 1.

The plug comprises a housing with a first contact face, a first set of pins for a first type of power point, and a first blocking device comprising interacting first and second blocking means. The first set of pins is slidably accommodated in the housing so as to assume an active or a passive position as desired, the first set of pins in the active position projecting from the first contact face of the housing in such a way that said set of pins can be inserted into the first type of power point. The first blocking means are connected to the first set of pins. The second blocking means are connected to the housing. The first and second blocking means are movable relative to each other, so that they can assume a blocking position, in which the slidability of the first set of pins is blocked, and an unblocking position, in which the first set of pins is slidable. The first blocking device furthermore comprises a first stopper, which first stopper is movable between a stop position, in which the movability of the first and second blocking means relative to each other is prevented, and a release position.

The stopper according to the invention provides a separate locking of the first and second blocking means, with the result that wear of the first and second blocking means less quickly leads to the blocking becoming less reliable.

In particular, the first stopper is movable in a sliding direction of the first set of pins. By making the stopper slidable in the same direction as the pins, it is ensured that an efficient use of space in the plug can be achieved. In the plug according to the prior art, on the other hand, the safety element slides transversely to the sliding direction of the pins, with the result that separate space has to be reserved for this inside the housing, at the axial end of the pins.

In one embodiment the second blocking means are intended to interact with the first blocking means to block the slidability of the first set of pins in the active position. The first blocking device furthermore comprises third blocking means, which are connected to the housing, for interacting with the first blocking means to block the slidability of the first set of pins in the passive position. In this way the blocking in both the active and the passive positions is achieved by the same blocking device, so that the first blocking means fulfils a dual function.

In particular, the first blocking device comprises a second stopper, which second stopper is movable between a stop position, in which the movability of the first and third blocking means relative to each other is prevented, and a release position. Thanks to the second stopper, the blocking in both the active and the passive positions can be reliably locked.

More particularly, the first and second stoppers are permanently connected to each other. This makes it possible to obtain one simple control system, in which by actuating one part both the first and the second stoppers can be moved into the release or the stop position.

In one embodiment the plug furthermore comprises a second set of pins for a second type of power point. In this way a so-called multiplug is formed, which multiplug advantageously can be used in several types of power points.

In particular, the plug furthermore comprises a double-sided sliding element, slidably accommodated in the housing so as to assume a first and a second position as desired. The double-sided sliding element comprises first and second pin faces. The second pin face is provided substantially diametrically opposite the first pin face. The first set of pins extends from the first pin face, and the second set of pins extends from the second pin face. The first set of pins in the first position projects from the first contact face of the housing in such a way that said set of pins can be inserted into the first type of power point. The second set of pins in the second position projects from a second contact face of the housing in such a way that said set of pins can be inserted into the second type of power point.

The use of such a common sliding element results not only in a simple construction, but also in simple operation. The locking of the sliding element in the active position for the first set of pins corresponds to the locking of the second set of pins in their passive position.

In a variant the second set of pins comprises at least three pins, one of which pins is an opener for a fused power point, such as a British power point. Furthermore, the first set of pins is provided on a first sliding element which is provided so as to be slidable around the opener of the second set of pins. By providing the sliding element around the opener of the second set of pins it is possible, if desired, to dispense with separate guide means for fixing the first set of pins during the sliding movement in the radial direction. It is pointed out that in the prior art described above the sliding movement is only along the opener, so that in that case additional guide means do have to be provided. A plug which is slidable around the opener of the second set of pins therefore offers advantages compared with the prior art which are independent of the other aspects of the invention.

In particular, the first blocking means are provided on the first sliding element, and the second blocking means are on the opener. The opener is permanently connected to the housing, and the stopper is provided in the opener. By providing the second blocking means on the opener and the stopper in the opener, a compact and simple construction is obtained.

Further preferred embodiments are described in the subclaims.

BRIEF DESCRIPTION OF THE DRAWINGS

The invention is explained in greater detail by means of preferred embodiments in the appended drawing, in which:

FIG. 6 shows a three-dimensional view of the embodiment of FIG. 1, with pins pushed in;

FIG. 18 shows the same section as that of FIG. 16, but with British pins pushed in;

DESCRIPTION OF THE PREFERRED EMBODIMENT

Figure 1:
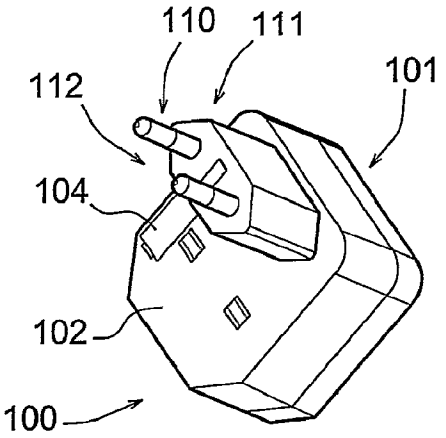
FIG. 1 shows a three-dimensional view of a first embodiment of a plug, with the European pins out.
Figure 2:
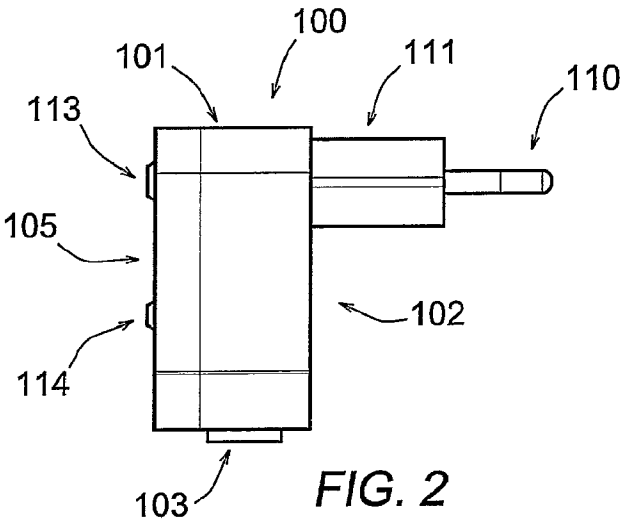
FIG. 2 shows a side view of the embodiment of FIG. 1.

FIG. 1 shows a plug according to a first embodiment of the invention, which is indicated in its entirety by the reference numeral 100. The plug 100 is intended for use as a mains plug for providing lighting and/or domestic appliances with power. The plug 100 comprises a housing 101, with a contact face 102. The housing 101 is furthermore provided with a lead-through aperture 103 (FIGS. 2 and 3) for a power cable, and with a cover 104 for closing an aperture for fitting a fuse, as is required in some countries. The cover is provided in a part of a rear wall 105. The rear wall 105 is the part of the housing 101 which is situated diametrically opposite the contact face 102.

The plug is provided with a first set of pins 110, the dimensions and mutual positioning of which make it suitable for use in a first type of power point, in the example shown a type of power point that is generally used on the continent of Europe. The pins 110 are slidably accommodated in a sliding housing 111. The set of pins 110 and the sliding housing 111 together form a plug of the so-called flat type. This is a plug which can be provided on appliances for which no earth connection is required.

The sliding direction of the pins 110 is also referred to below as the axial direction, while a radial direction is crosswise to the axial direction. In this first exemplary embodiment the axial direction corresponds to a direction from the rear wall 105 towards the contact face 102.

Figure 3:
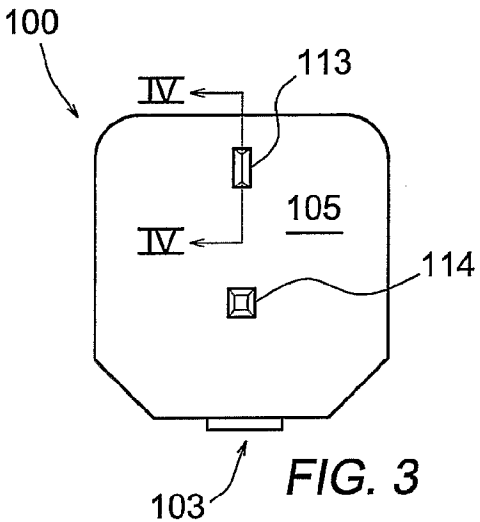
FIG. 3 shows a front view of the embodiment of FIG. 1.
Figure 13:
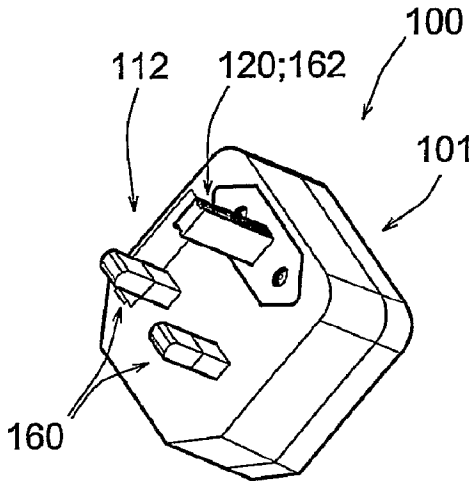
FIG. 13 shows a three-dimensional view of the first embodiment, with British pins pushed out.
Figure 14:
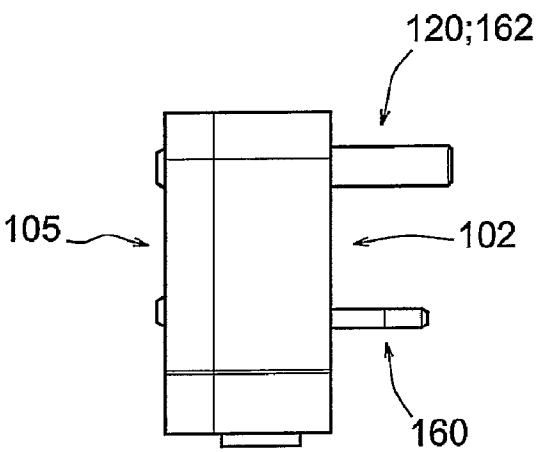
FIG. 14 shows a side view of FIG. 13.
Figure 15:
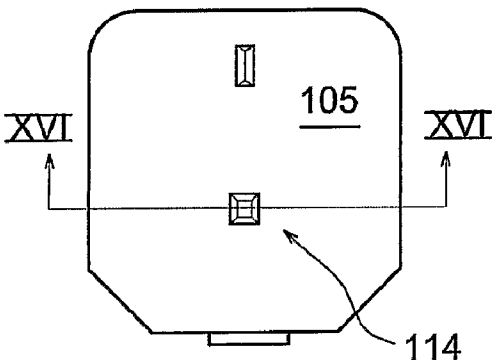
FIG. 15 shows a front view of FIG. 13.

In FIG. 1 the ends of a second set of pins 112 are also visible, which second set of pins will be reverted to in more detail later in relation to FIG. 13 onwards. In FIG. 3 a first push button for the European flat plug, or Euro push button 113, can also be seen. A British push button 114 can also be seen.

Figure 4:
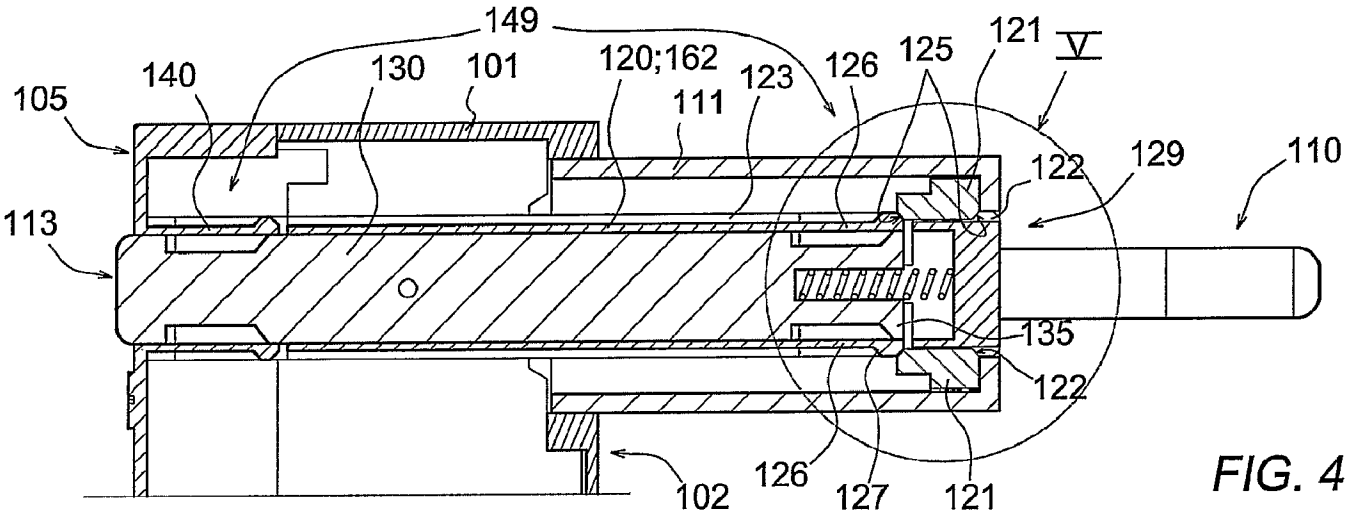
FIG. 4 shows a section along line IV-IV of FIG. 3.

With reference to FIG. 4, the sliding housing 111 is slidably accommodated in the housing 101. For this purpose, sliding guide means are accommodated in the form of a sliding tube 120. The first set of pins 110 is permanently connected to a first sliding element 121, in this case a single-sided sliding element, also referred to as a bridge. The single-sided sliding element 121 is provided with two sliding lugs 122, which are placed diametrically opposite each other and can slide in grooves 123 of the sliding tube 120. The single-sided sliding element 121 extends round the sliding tube 120. In other words, the single-sided sliding element 121 is provided with an aperture which corresponds to the outside of the sliding tube 120. Owing to the fact that the first sliding element 121 is of a certain thickness, the aperture can be seen as a tubular aperture.

Figure 5:
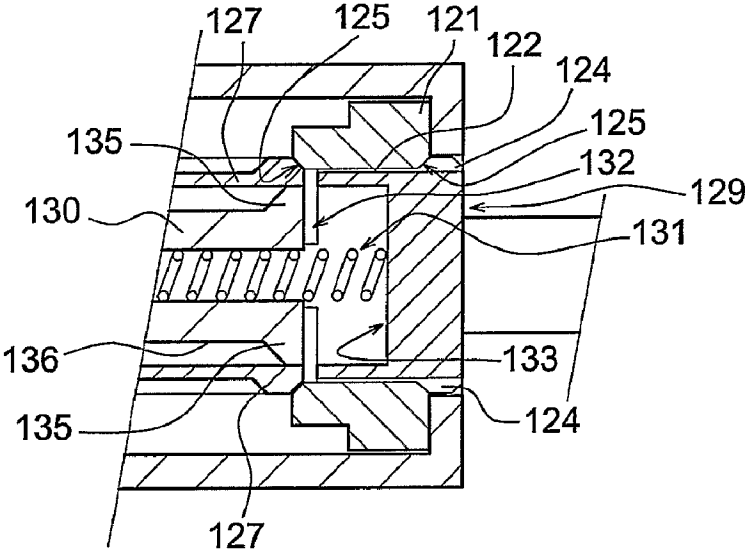
FIG. 5 shows detail V of FIG. 4.
Figure 8:
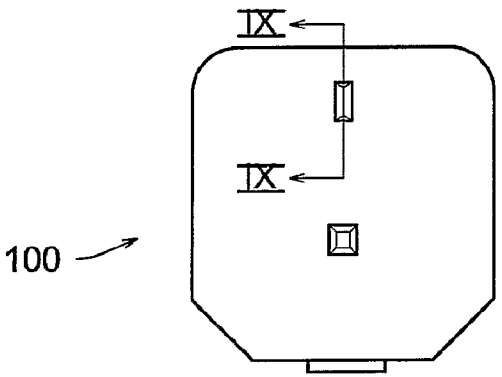
FIG. 8 shows a front view of FIG. 6.

The sliding tube 120 is provided with one or more first stops 124 (FIG. 5). The first stops 124 are bevelled on their side facing the contact face 102. The sliding lug 122 of the single-sided sliding element 121 is bevelled in a complementary manner. The sliding lug 122 is also bevelled on its axially opposite side. The bevelled sides or faces of the sliding lug 122 can be regarded as first blocking means 125. The sliding tube 120 is provided with second blocking means in the form of blocking lips 126. The blocking lips 126 are movably, in this example hingedly, connected to the sliding tube 120. In this exemplary embodiment the blocking lips 126 are formed by leaving away material of the sliding tube 120 along three sides of the blocking lip 126. Along the fourth side of the blocking lips 126, i.e. the side where no material is left away, the material of the sliding tube 120 acts as a hinge. By selecting slightly elastic material for the sliding tube 120, the strip of material concerned is not only hinged, but also elastic.

The blocking lip 126 is provided with a blocking lug 127. The blocking lug 127 is provided with bevelled walls, the bevel of which corresponds to that of the bevelled sides 125 of the sliding lug 122.

For the sake of completeness, it is pointed out that in the sectional drawing according to FIGS. 4 and 5 it appears as if one end 129 of the sliding tube 120 is not connected to the main part of the sliding tube 120. This is the end 129 situated on the side of the first contact face 102. It can be seen more clearly in FIGS. 9 and 13 that this is in fact a continuous sliding tube 120, in which only the blocking lips 126 are partially detached from the remainder of the tube.

A stop element in the form of a stop bar 130 is accommodated in the sliding tube 120. A first end of the stop bar 130 acts as the Euro push button 113 here. The other end of the stop bar 130, i.e. the end of the stop bar 130 projecting from the contact face 102, is provided with spring means in the form of a coil spring 131. The coil spring 131 is accommodated in an opening 132 on the axial end of the stop bar 130, and projects partially from said end face 132. The coil spring 131 rests on one side in the opening and on the other side on an inside edge 133 of the end 129 of the sliding tube 120.

The stop bar 130 is provided with one or more first stoppers 135. The stoppers 135 can be regarded as lugs or radially projecting parts on the outside wall of the stop bar 130. In this case there can be two or more stoppers 135, or there can be one stopper 135 extending in the circumferential direction round the stop bar 130. It is pointed out that the central part of the stop bar 130 has the same external diameter as the external diameter of the circumference round the stoppers 135. This is in particular functional for the slidable accommodation of the stop bar 130 in the sliding tube 120. However, the diameter of this central part of the stop bar is not relevant for the stop function of the stoppers 135. What is relevant is that the diameter of the part 136 of the stop bar 130 which in the axial direction directly adjoins the first stoppers 135 has a smaller diameter than the diameter round the circumference of the stoppers 135. As will emerge below, the recessed part 136 of the stop bar 130 has a function in the releasing of the blocking means.

Figure 9:
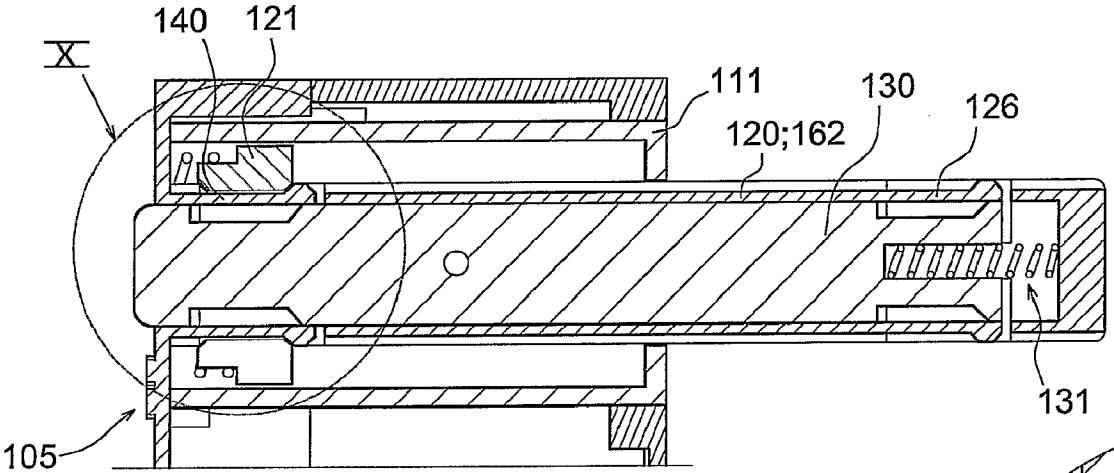
FIG. 9 shows a section along line IX-IX in FIG. 8.
Figure 10:
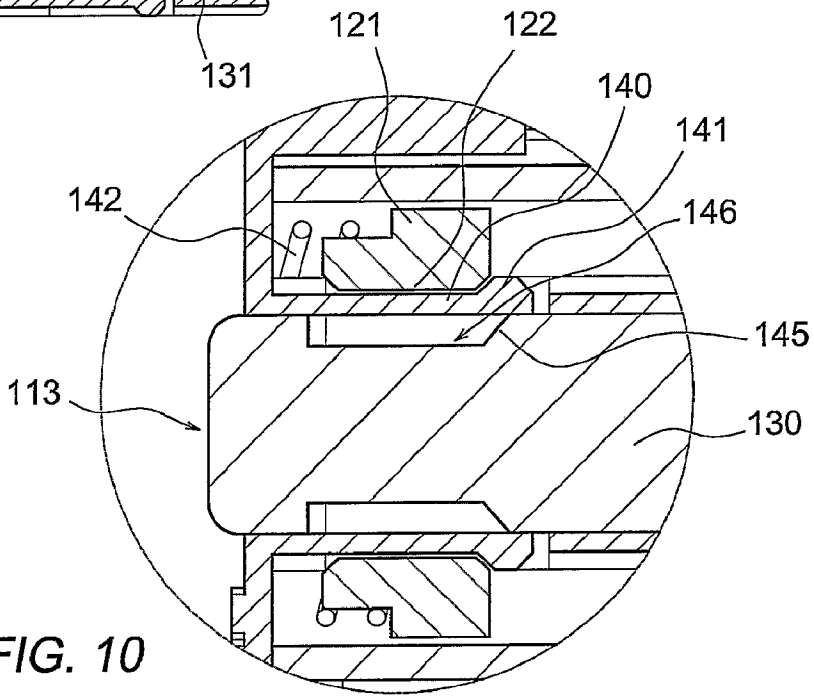
FIG. 10 shows a detail X of FIG. 9.

FIGS. 6-10 show the plug 100 in a position in which both the first set of pins 110 and the second set of pins 112 are slid into the housing, but not the opener to be described below. FIGS. 9 and 10 show the interaction between the above-described first blocking means 125 of the single-sided sliding element 121 and the third blocking means to be described below.

Figure 6:
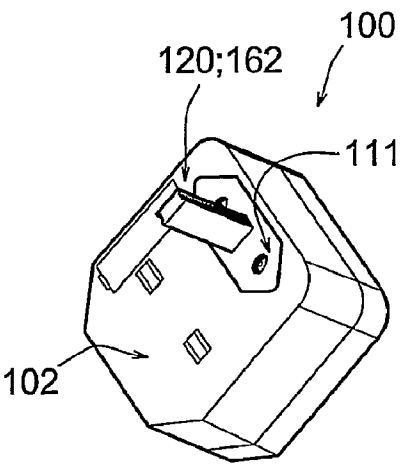
Figure 7:
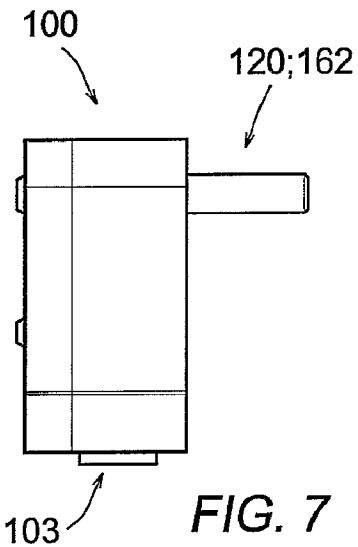
FIG. 7 shows a side view of FIG. 6.

In FIGS. 9 and 10 the single-sided sliding element 121, the first set of pins 110 connected to it (not visible in this section) and the sliding housing 111 are pushed fully into the housing 101. It is pointed out that the axial end of the sliding housing 111 lies in the same plane as the contact face 102, as can be seen in FIG. 6.

The sliding tube 120 is provided with third blocking means, in the form of blocking lips 140. The blocking lips 140 are provided with blocking lugs 141. The blocking lugs 141 have bevelled sides which correspond to the bevel of the first blocking means, or the bevelled faces 125 of the sliding lug 122. In the space between the sliding housing 111 and the sliding tube 120 spring means 142 are also provided, in the form of a coil spring. The coil spring 142 acts, at least in the position shown in the drawing, upon the single-sided sliding element 121 and upon the inside of the housing 101. In this way the coil spring 142 exerts an axial force from the rear wall 105 of the housing 101 towards the contact face 102.

The stop bar 130 is provided with a second stopper 145. The second stopper 145 at a first axial end merges into the above-described central part of the stop bar 130. At its second axial end the second stopper 145 adjoins a part 146 of the stop bar 130 with a reduced diameter.

The blocking lip 140 in this example is formed from and connected to the sliding tube 120 in a comparable way to that of the first blocking lip 126.

Thus a first blocking device 149 is formed, comprising the bevelled faces 125, blocking lips 126 and 140 with blocking lugs 127 and 141 respectively, and the axial stop bar 130 with stoppers 135 and 145.

Figure 11:
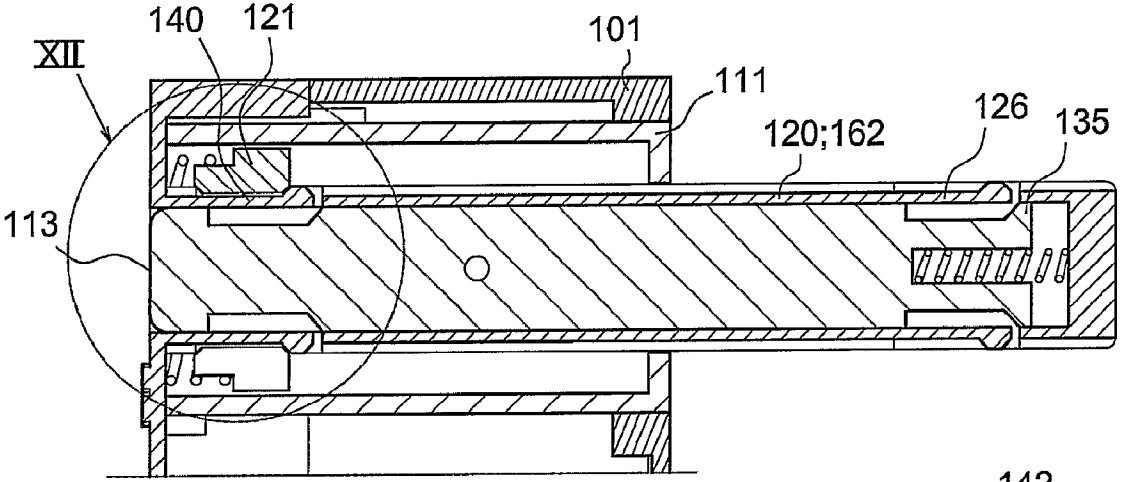
FIG. 11 shows the same view as that of FIG. 9, but with push button pressed.
Figure 12:
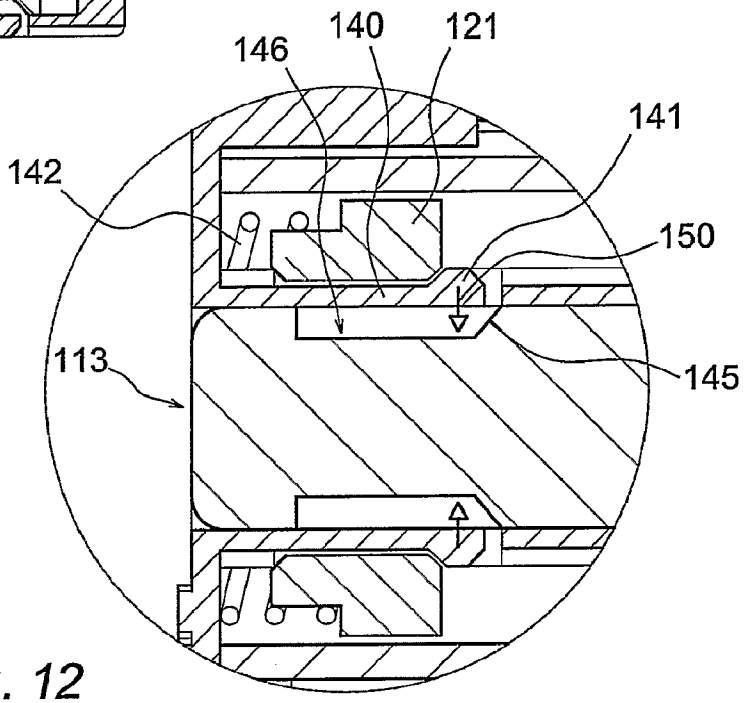
FIG. 12 shows detail XII of FIG. 11.

In use, the Euro push button 113 can be pressed in the axial direction, as shown in FIGS. 11 and 12. Operating, i.e. pressing, the Euro push button 113 causes the stop bar 130, and therefore also the stoppers 135 and 145, to move in the axial direction. The axial movement of the stoppers 135 and 145 means that said stoppers move in the axial direction relative to the blocking lips 126 and 140, thereby releasing the blocking lips 126 and 140. In other words, the blocking lips 126 and 140 come to rest at the position of the parts 136 and 146 of the blocking bar 130 with reduced circumference. The first stopper 135 and the second stopper 145 are thus moved from a stop position to a release position. In the stop position the radial movability of the blocking lips 126 and 140 relative to the sliding lug or the first blocking means 125 was prevented. In the release position the blocking lips 126 and 140 are movable in the radial direction, as shown by arrows 150 for the second blocking lips 140.

Partly as a result of the bevelled shape of the blocking lugs 127 and 141 respectively and the bevelled sides 125 of the sliding lug 122, the sliding lug 122 can move the blocking lips 126 and 140 out of their blocking position (shown) into an unblocking position (not shown). In the unblocking position (not shown) the sliding lips 126 and 140 are situated in the opening that is formed by the parts 136 and 146 of the stop bar 130 that have a reduced cross section.

From the position in FIGS. 11 and 12 the coil spring 142, in the release position of the stopper 145, as shown in FIG. 11, will provide for the blocking lips 126 and 140 to be pushed into the unblocking position. From the pushed-out, active position of the first set of pins 110 and the sliding housing 111, as shown in FIGS. 1-4, the user himself will push the single-sided sliding element 121 inwards in the axial direction and in so doing push the blocking lip 126 radially inwards. For this purpose, the user can exert force upon the first set of pins 110 and/or the sliding housing 111.

FIGS. 13-18 show the same first embodiment of the plug 100, in which the mode of operation of the second set of pins 112 is explained. The second set of pins 112 comprises two live pins 160 and an opener 162. The opener 162 is also referred to as an earth pin, but because the plug 100 in the exemplary embodiment shown is not earthed, the term opener is a better description here. For British power points a pin must in fact be present at the position of the earth pin even in the case of non-earthed plugs, in order to unblock the power point concerned.

The opener 162 in this exemplary embodiment is the equivalent of the sliding tube 120, and in this embodiment is permanently connected to the housing 101. For the British pins 112, and in particular the two slidable pins 160, a second blocking device 165 is provided.

The plug 100 comprises sliding guide means in the form of a second sliding tube 170, which is permanently connected to the housing 101 and extends inside the housing from the rear wall 105 to the contact face 102. This direction will hereinafter be referred to as the axial direction, and is also the sliding direction for the pins 160.

A stop 172 is provided on the inside of the contact face 102, which stop extends round the second sliding tube 170. The pins 160 are connected to a second, likewise single-sided sliding element, in this case a bridge 171. The bridge 171 is provided with an aperture which extends round the sliding tube 170. The thickness of the bridge 171 at the position of the aperture is such that this is a matter of a tubular aperture in the bridge 171, which tubular aperture extends round the sliding tube 170. The bridge 171, or at any rate its tubular aperture, is provided with two bevelled faces which bound the tubular aperture in the bridge 171. Said bevelled faces 175 act as the fourth blocking means.

The sliding tube 170 is provided with fifth blocking means in the form of third blocking lips 176 with blocking lugs 177. The blocking lugs 177 are bevelled for interaction with the bevelled faces 175 of the bridge 171. The blocking lips 176 are formed from the sliding tube 170 in a comparable way to the blocking lips described earlier.

The slanting faces 175 and the third blocking lips 176 with blocking lugs 177 are part of the second blocking device 165. The second blocking device 165 furthermore comprises a second stop element in the form of a second stop bar 180. The stop bar 180 is provided with a coil spring 181 on an axial end. The stop bar 180 is furthermore provided with a third stopper 185. The third stopper 185 is formed by an opening, i.e. a part 186 of the stop bar 180 with a reduced diameter which axially adjoins the stopper 185.

The sliding tube 170 is furthermore provided with fourth blocking lips 190, having fourth blocking lugs 191. The second stop bar 180 is provided with fourth stoppers 195. The fourth stoppers 195 are formed by means of an opening 196 in the stop bar 180. These fourth blocking lips 190 and fourth stoppers 195 can also be regarded as parts of the second blocking device 165.

Figure 16:
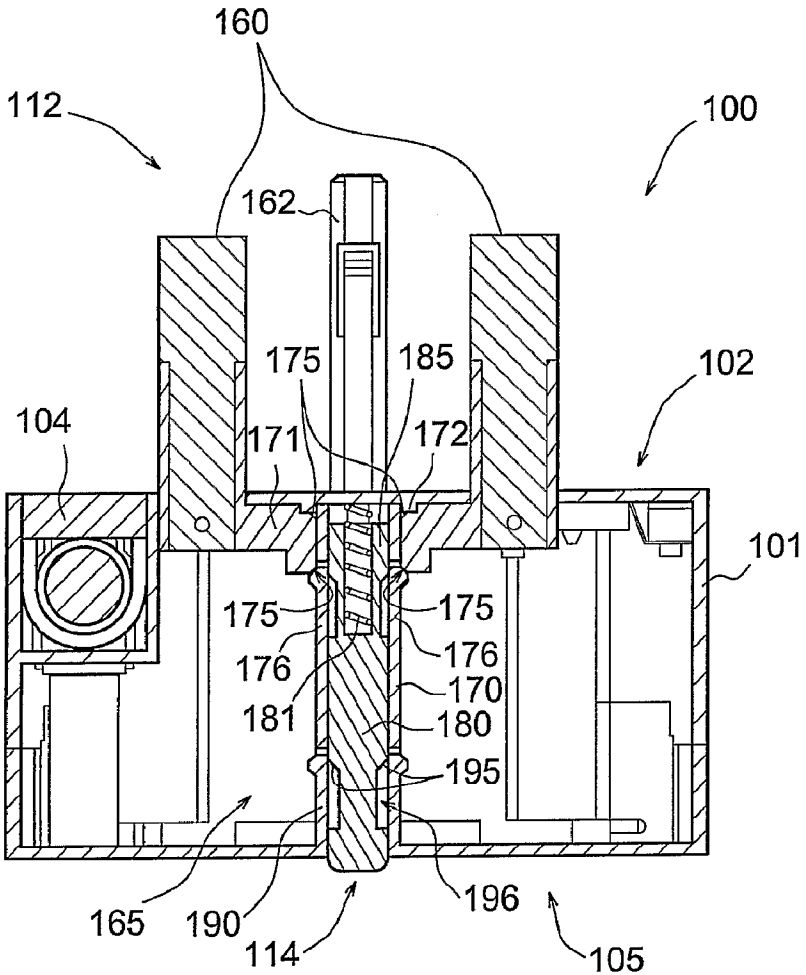
FIG. 16 shows a section along line XVI-XVI of FIG. 15.

In the use position shown in FIG. 16 the plug 100 is ready for use in combination with a British power point. The pins 160 are blocked by the interaction of the fourth blocking means 175 and fifth blocking means 176. In this case the stopper 185 prevents radial movability of the blocking means 176 relative to the blocking means 175. A certain blocking of the pins 160 is thereby obtained.

Figure 17:
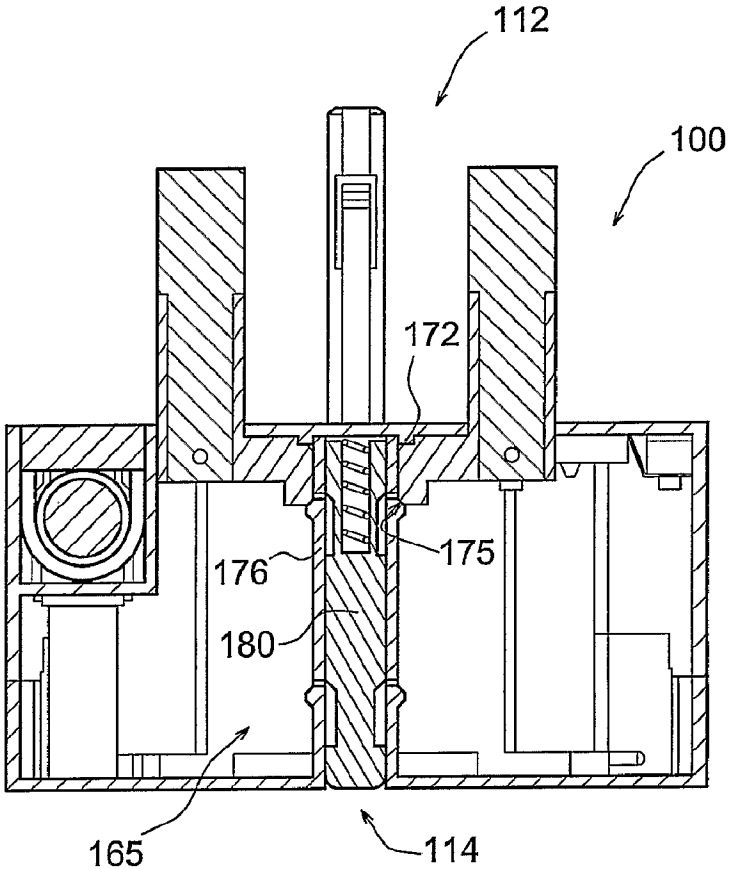
FIG. 17 shows the same view as that of FIG. 16, but with push button pressed.

In FIG. 17 a user has pressed the British push button 114 and thereby moved the stop bar 180 in the axial direction. This makes the stopper 185 move in the axial direction away from the blocking lips 176, and the blocking lips 176 are movable in the radial direction relative to the blocking faces 175 of the bridge 171. By exerting pressure in the axial direction upon the bridge 171, for example by way of the pins 160, the bridge 171 with the pins 160 can now be slid inwards along the sliding tube 170. The blocking lips 176 are moved radially inwards in the process.

Figure 18:
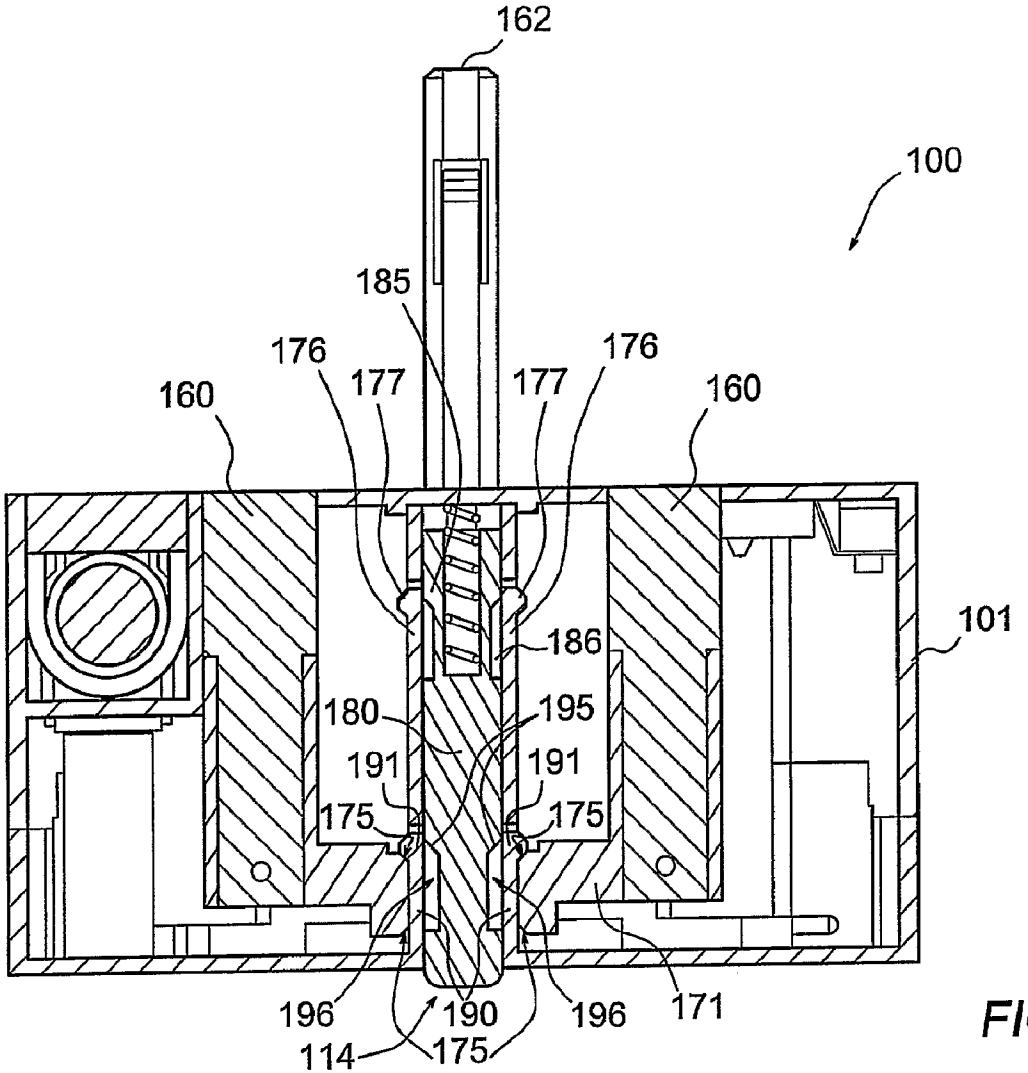

After the pins 160 have been slid in fully and in the meantime the push button 114 has been released by the user, the situation shown in FIG. 18 is produced. This is in fact the same situation as that shown in FIGS. 6-10, but in this case at the position of the same sectional plane as that in FIGS. 16 and 17. The bridge 171 is blocked in this position by blocking lips 190, more particularly by the blocking lugs 191 provided on the blocking lips 190. Thanks to the stoppers 195, the blocking lips 190 and the blocking faces 175 on the bridge 171 cannot move relative to each other in this position, with the result that the pins 160 are blocked in the passive position shown in FIG. 18. The release from this blocked passive position is performed in a way corresponding to that described above in relation to the release from the active position.

The figures described above do not show that the first set of pins 110 and the second set of pins are disconnectably electrically connected by means of contacts to power cables which are run through the cable lead-through aperture 103 to the outside of the plug 100. Thanks to the contacts, only one set of pins at a time is connected to the power cables.

Figure 19:
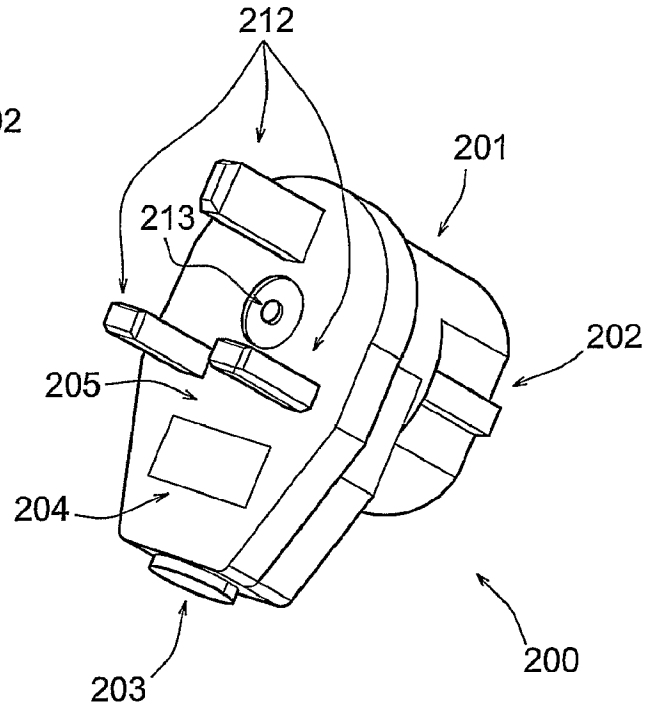
FIG. 19 shows a three-dimensional view of a second embodiment of a plug, with the British pins out.
Figure 20:
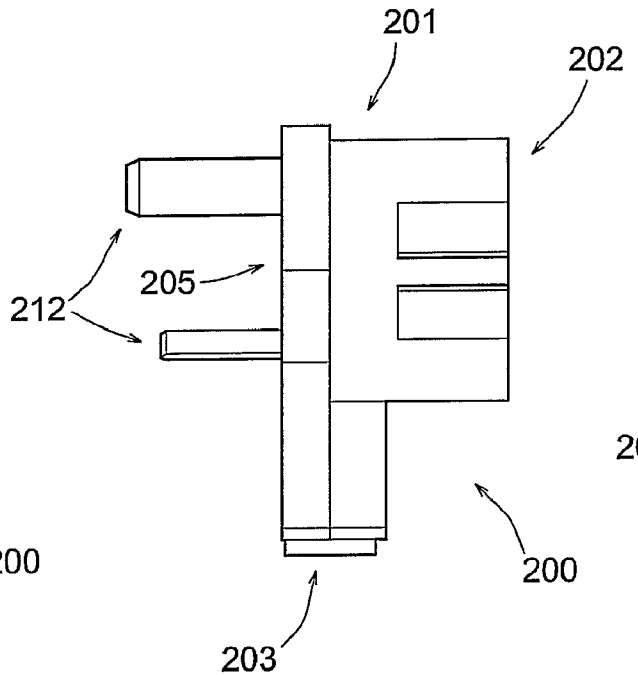
FIG. 20 shows a side view of the embodiment of FIG. 19.
Figure 21:
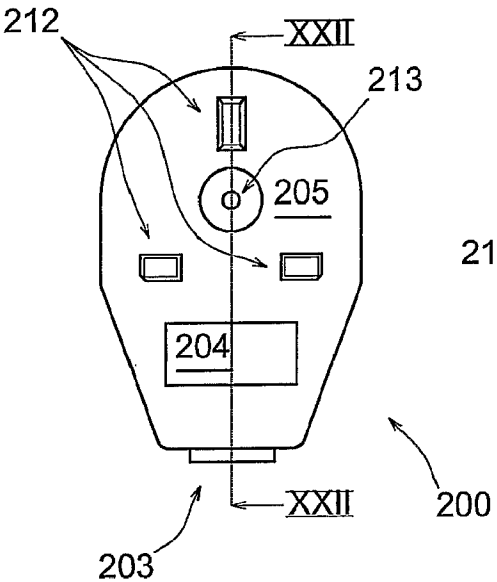
FIG. 21 shows a front view of the embodiment of FIG. 19.
Figure 23:
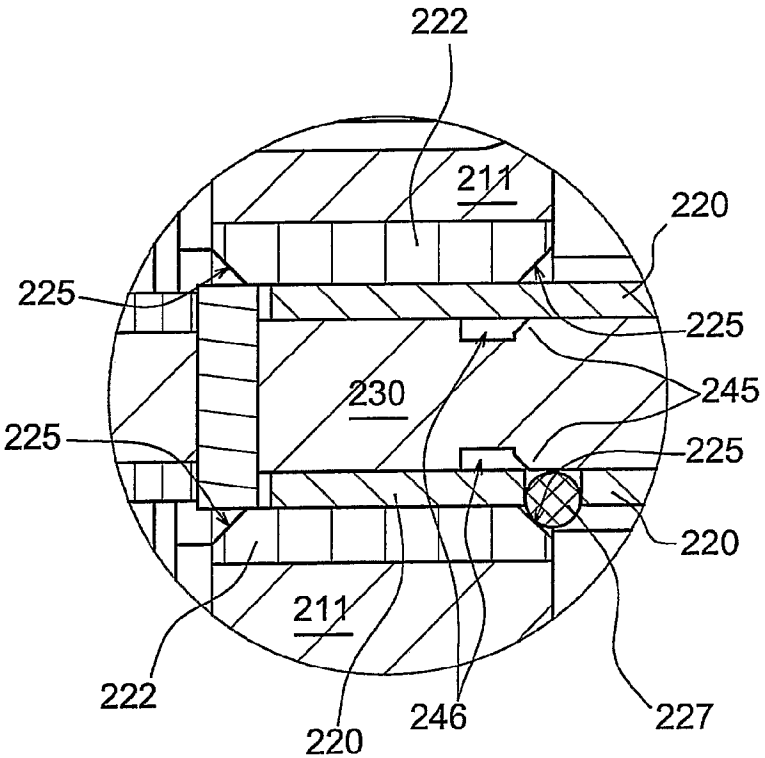
FIG. 23 shows detail XXIII of FIG. 22.

FIG. 19 shows a plug 200 according to a second embodiment of the invention. The plug 200 is intended for use as a mains plug, for earthed applications. The plug 200 comprises a housing 201 with a first contact face 202. The housing 201 is furthermore provided with a lead-through aperture 203 for a power cable and a cover 204 for a fuse. The housing 201 furthermore comprises a second contact face 205, which is provided substantially diametrically opposite the first contact face 202. The shape and dimensions of the first contact face 202 correspond to those of an earthed power point of a first type, in this case of the type usually found on the continent of Europe. The shape and dimensions of the second contact face 205 correspond to those of power points of a second type, in this case, for example, of the type usually found in the British Isles.

Figure 26:
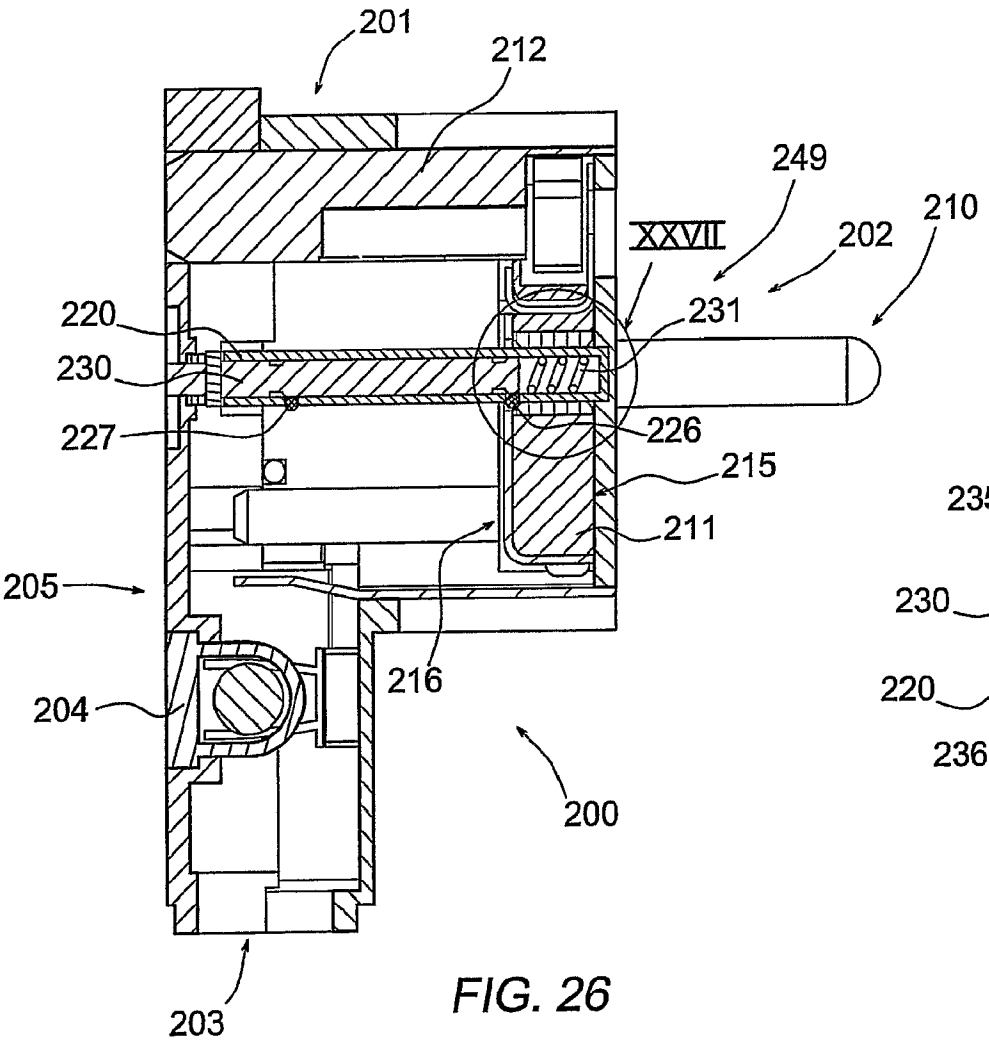
FIG. 26 shows the same section as that of FIGS. 22 and 24, with the European pins out.
Figure 28:
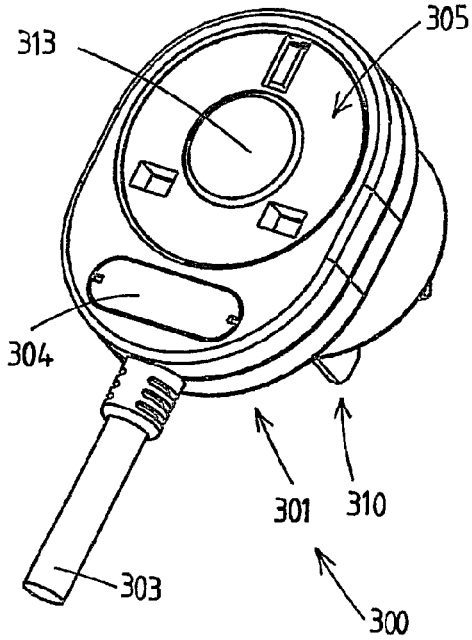
FIG. 28 shows a three-dimensional view of a third embodiment of a plug, with the Chinese pins out.
Figure 29:
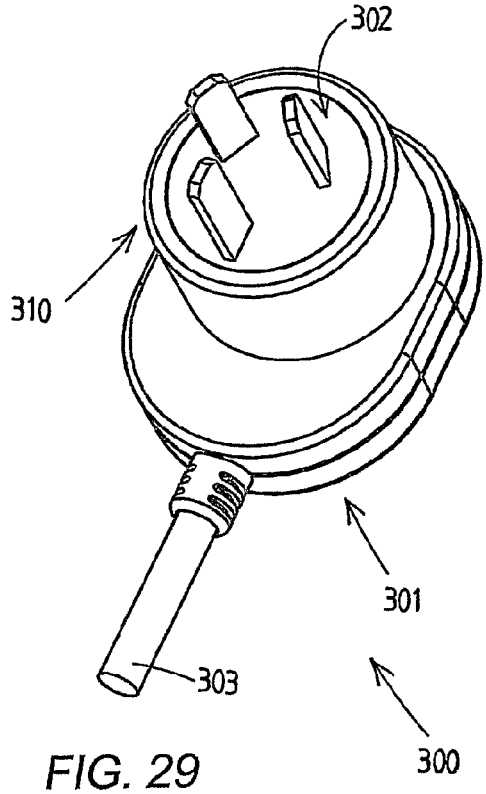
FIG. 29 shows a three-dimensional view from an opposite direction of the plug of FIG. 28.
Figure 30:
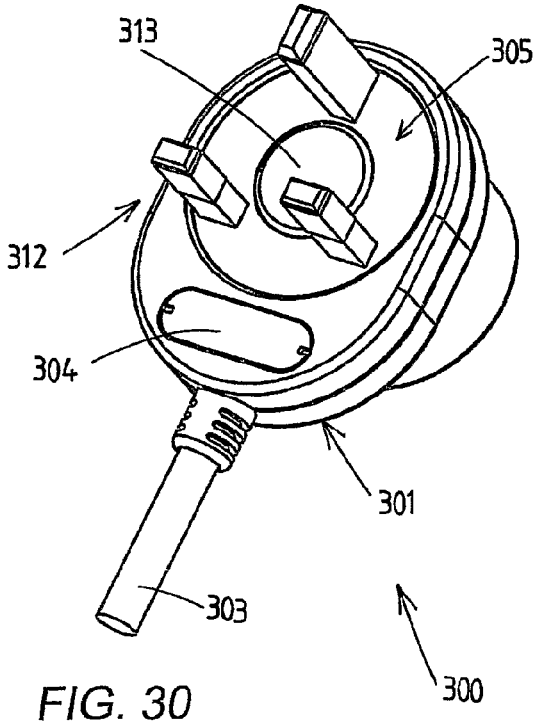
FIG. 30 shows the plug of FIG. 28, in the view of FIG. 28, with British pins out.
Figure 31:
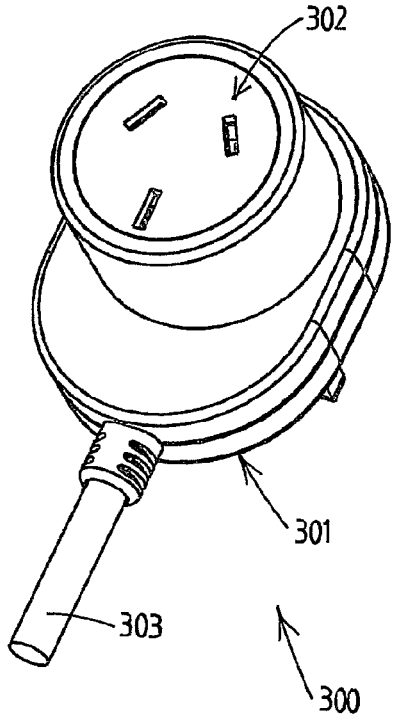
FIG. 31 shows the plug of FIG. 28, in the view of FIG. 29, with British pins out.
Figure 32:
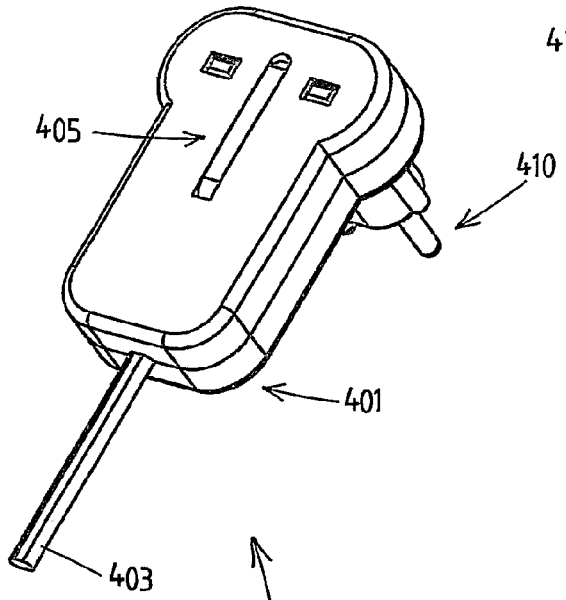
FIG. 32 shows a three-dimensional view of a fourth embodiment of a plug, with integral charging electronics, with European pins out.
Figure 33:
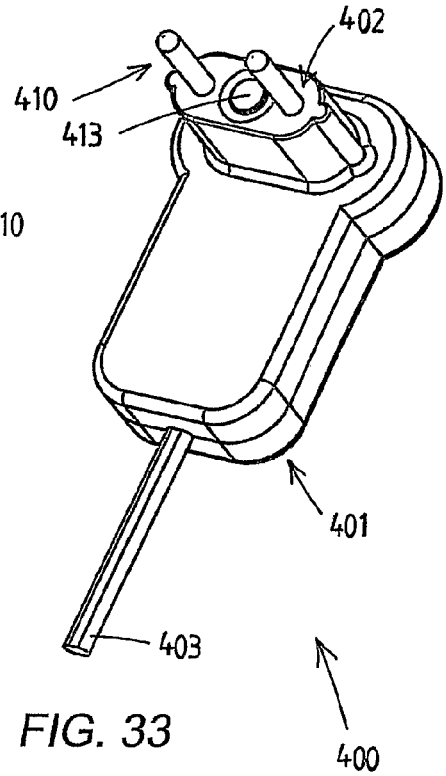
FIG. 33 shows a three-dimensional view from an opposite direction of the plug of FIG. 32.
Figure 34:
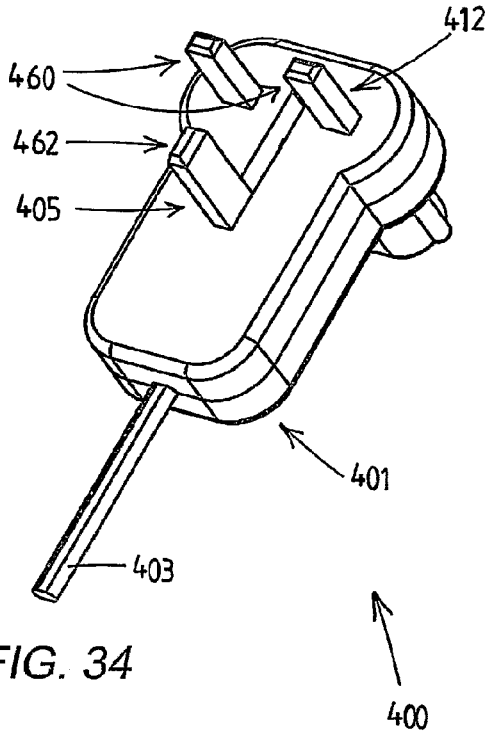
FIG. 34 shows the plug of FIG. 32, in the view of FIG. 32, with British pins out.
Figure 35:
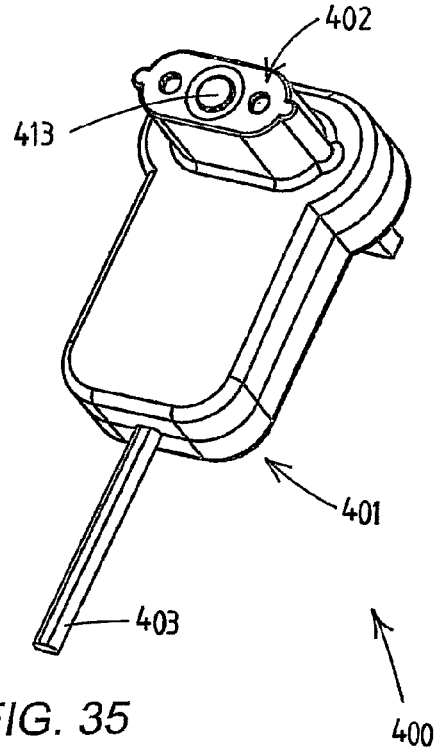
FIG. 35 shows the plug of FIG. 32, in the view of FIG. 33, with British pins out.

The plug 200 is provided with a first set of pins 210 (FIG. 26), which is suitable for use in the first type of power point. The first set of pins 210 is provided on a sliding element 211, in this case a double-sided sliding element 211. The sliding element 211 is slidably accommodated in the housing 201, so that it can optionally assume a first position (FIG. 22) and a second position (FIG. 26).

The plug furthermore comprises a second set of pins 212 (FIGS. 19-24), suitable for the second type of power point, and a push button 213. The push button 213 is recessed in the second contact face 205.

The sliding element 211 comprises a first pin face 215. The first set of pins 210 extends from the first pin face 215, in this case perpendicularly to the pin face 215. For this purpose, the first set of pins 210 is permanently connected to the sliding element 211. The sliding element 211 furthermore comprises a second pin face 216, from which the second set of pins 212 extends. The second set of pins 212 is located so as to be perpendicular to the second pin face 216 and is permanently connected to the double-sided sliding element 211. The first pin face 215 and second pin face 216 of the sliding element 211 are provided diametrically opposite each other on the sliding element 211.

With reference to FIGS. 22-27, the double-sided sliding element 211 is slidably accommodated in the housing 201. For this purpose, sliding guide means are provided in the form of a sliding tube 220. The double-sided sliding element 211 is provided with two sliding lugs 222, which are placed diametrically opposite each other and can slide in grooves 223 of the sliding tube 220. The sliding tube 220 extends from the first contact face 202 to the second contact face 205. For what follows below the axial direction is defined as the sliding direction of the double-sided sliding element 211, which in this case is determined by the longitudinal direction of the sliding tube 220.

The double-sided sliding element 211 extends round the sliding tube 220. For this purpose, the double-sided sliding element 211 is provided with an aperture, in particular a tubular aperture, the dimensions of which substantially correspond to the outside of the sliding tube 220.

The sliding lugs 222 are bevelled on two sides situated diametrically opposite each other to form fourth blocking means, or blocking faces 225. It is pointed out that the blocking faces 225 are situated on the axial ends of the sliding lugs 222.

The sliding tube 220 is provided with fifth and sixth blocking means, in the form of first and second blocking balls 226 and 227. The first and second blocking balls 226 and 227 are movably connected to the sliding tube 220 in such a way that they are movable in the radial direction relative to the sliding tube 220, and are fixed, i.e. not movable, in the axial direction of the sliding tube 220.

The sliding tube 220 is accommodated with a first end 229 in the part of the housing 201 which forms the first contact face 202.

A stop element in the form of a stop bar 230 is accommodated in the sliding tube 220. A first end of the stop bar 230 acts as the push button 213 here. At the other end of the stop bar 230 spring means are provided in the form of a coil spring 231. The coil spring 231 rests on one side on the axial end face 232 of the stop bar 230 and rests on the other side on an inside edge 233 of the end 229 of the sliding tube 220.

The stop bar 230 is provided with a first stopper in the form of a stop ring 235. The stop ring 235 is bounded at its first axial end by the end face 232. At its second axial end the stop ring 235 is bounded by a part of the stop bar 230 with a reduced cross section 236. Owing to the fact that the remainder of the stop bar 230, notably the central part of the stop bar 230, has an external diameter which corresponds to the external diameter of the stop ring 235, the part 236 with a reduced cross section can also be regarded as a circular opening or groove 236.

The stop bar 230 is furthermore provided with a second stopper 245. The second stopper 245 can be regarded as a second stop ring 245, which extends round the external surface of the stop bar 230. The second stop ring 245 at an axial end merges into the central part of the stop bar 230. Owing to the fact that the stop ring 245 and the central part of the stop bar 230 have the same external diameter, the second stop ring 245 in this case merges seamlessly into the remainder of the stop bar 230. At a second axial end the second stop ring 245 is bounded by a part 246 of the stop bar 230 with a reduced diameter. The part 246 with reduced diameter can also be regarded as a circular opening or groove 246 in the surface of the stop bar 230. The blocking faces 245 of the sliding lug 222, the first blocking ball 226 and second blocking ball 227 and the first stop ring 235 and second stop ring 245 are part of a blocking device 249.

Figure 22:
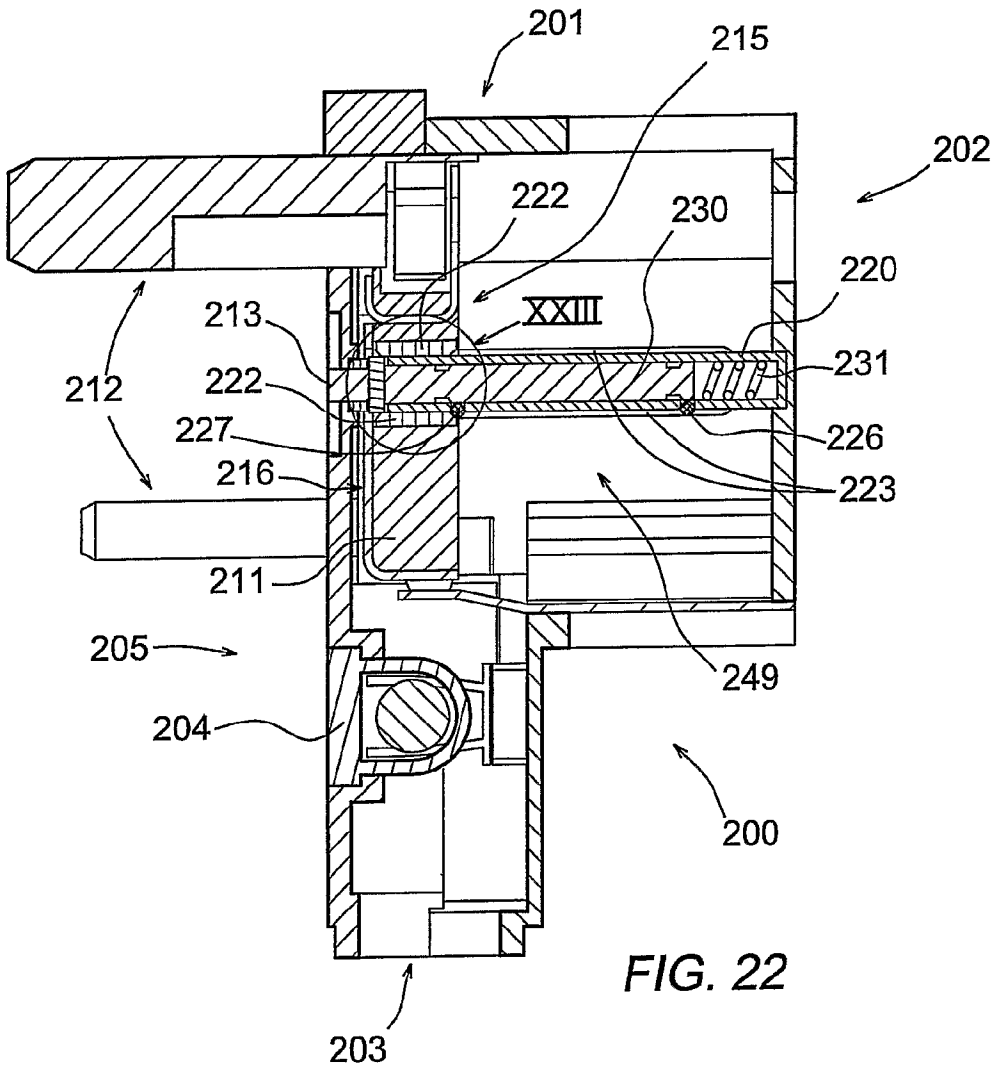
FIG. 22 shows a section along line XXII-XXII of FIG. 21.

In the use position of FIG. 22, in other words the position in which the plug 200 is suitable for power points of the British type, the second set of pins 212 is blocked in a certain way. The blocking faces 225 are resting upon the blocking ball 227, which in turn can transmit an axial force to the sliding tube 220, and therefore to the housing 201. The blocking ball 227 is locked in the blocked use position, or is stopped by the second stop ring 245. The blocking ball 227 consequently cannot move in the radial direction.

Figure 25:
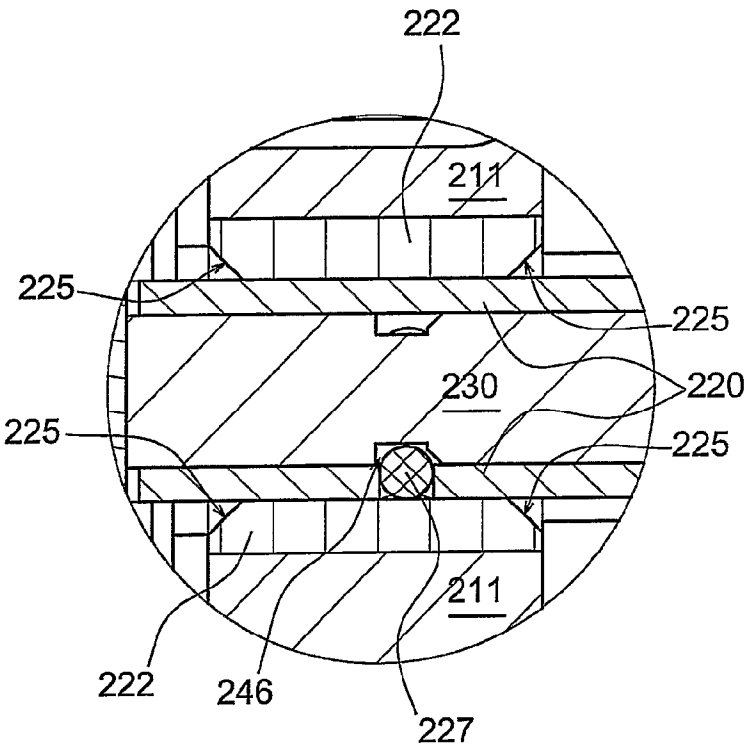
FIG. 25 shows detail XXV of FIG. 24.
Figure 24:
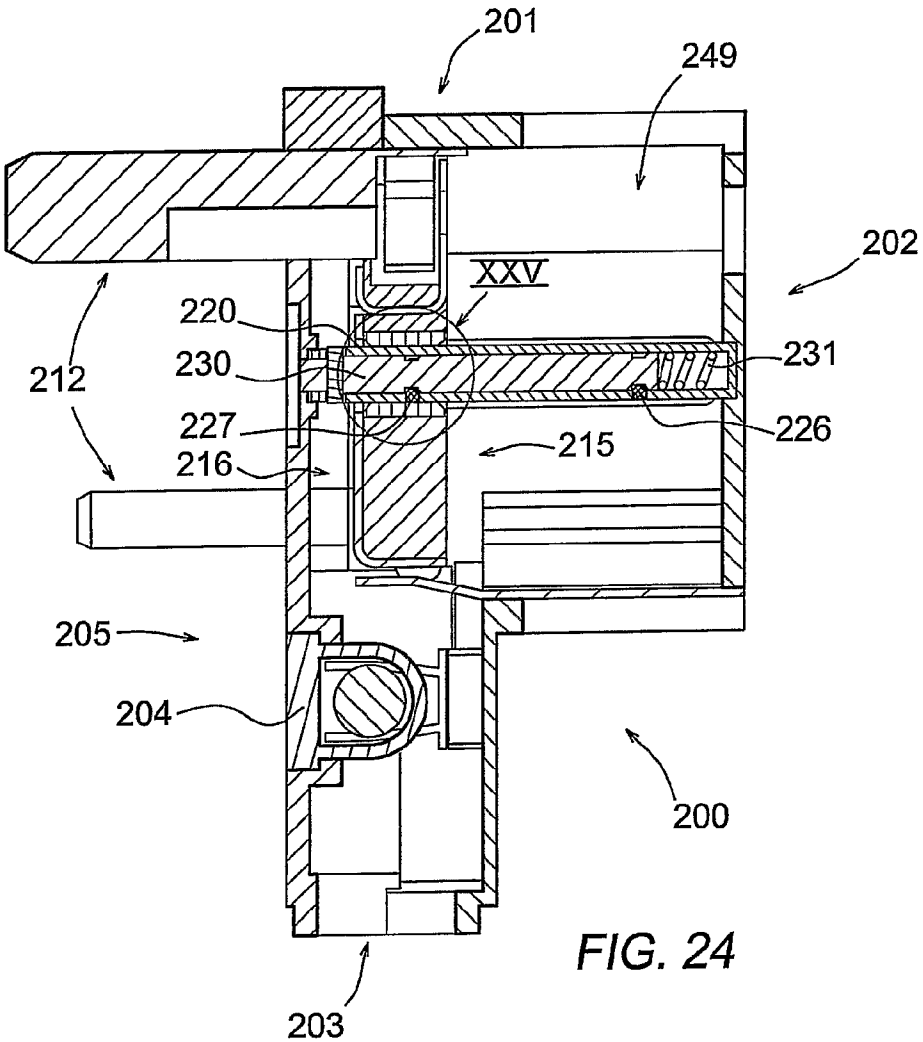
FIG. 24 shows the same section as that of FIG. 22, with push button pressed.

By pressing the push button 213 against the spring force of coil spring 232, the second stop ring 245 is made to move away from the second blocking ball 227. The fact that the first stop ring 235 and second stop ring 245 are connected to each other by the stop bar 32 means that at the same time the first stop ring 235 moves away from the first blocking ball 227. However, this is not important in the position shown in FIGS. 22 and 23. The axial movement away from the second stop ring 245 causes the second circular opening 246 of the stop bar 230 to reach the position of the second blocking ball 227 (FIGS. 24, 25). Simultaneously exerting force in the axial direction upon the double-sided sliding element 211, for example by way of the second set of pins 212, will cause the slanting blocking face 225 to push the second blocking ball 227 into the second circular opening 246.

Figure 27:
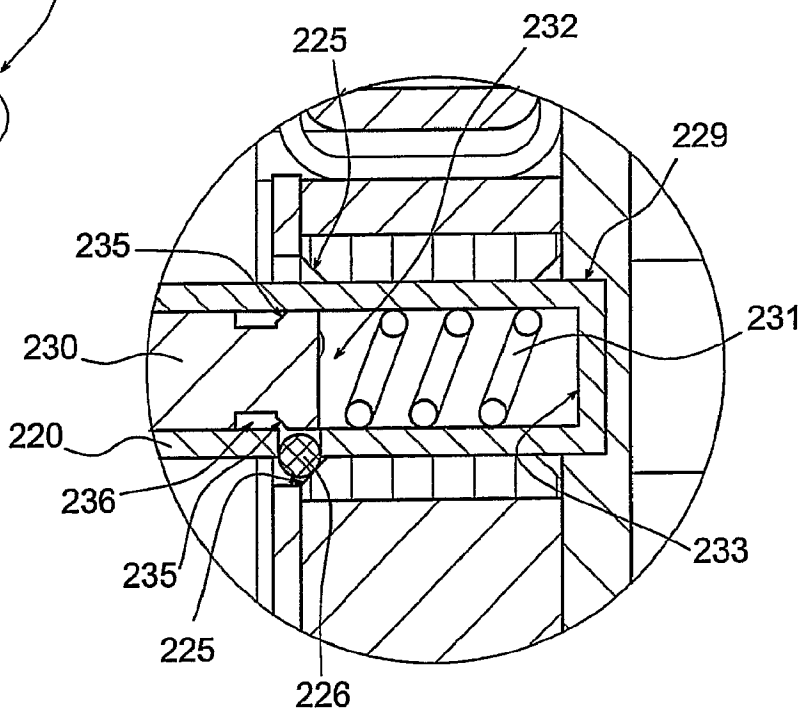
FIG. 27 shows detail XXVII of FIG. 26.

This gives rise to the situation shown in FIG. 25. In this release position of the second stop ring 245 the blocking action between the blocking faces 225 and the blocking ball 227 is removed. The situation shown in FIGS. 26 and 27 is produced by then pushing the sliding element 211 on further and releasing the push button 213. The double-sided sliding element 211, and consequently the first set of pins 210, is now blocked in the axial direction by way of blocking face 225 of sliding lug 222 and first blocking ball 226, which itself rests upon the sliding tube 220. The first blocking ball 226 is not movable in the radial direction, owing to the presence of the first stop ring 235.

If the push button 213 is pressed again, in the situation of FIG. 27 a situation broadly corresponding to that of FIG. 25 will arise. The first circular opening 236 will go to the position of the first blocking ball 226, making the latter movable in the radial direction, so that the blocking effect between the first blocking ball 226 and the blocking face 225 is removed.

FIGS. 28-31 show a plug 300 according to a third embodiment of the invention. The plug 300 is intended for use as a mains plug, for earthed applications. The plug 300 comprises a housing 301 with a first contact face 302. The housing 301 is furthermore provided with a power cable 303 and a cover 304 for a fuse. The housing 301 furthermore comprises a second contact face 305, which is provided substantially diametrically opposite the first contact face 302.

The shape and dimensions of the first contact face 302 correspond to those of an earthed power point of a first type, in this case of the type usually found in China. The shape and dimensions of the second contact face 305 correspond to those of power points of a second type, in this case of the type usually found in the British Isles, Ireland and Hong Kong.

The plug 300 is provided with a first set of pins 310, which is suitable for use in the first type of power point. The first set of pins 310 is provided on a double-sided sliding element (not shown). The sliding element is slidably accommodated in the housing 301, so that it can assume a first position (FIGS. 28 and 29) and a second position (FIGS. 30 and 31) as desired.

The plug 300 furthermore comprises a second set of pins 312 and a push button 313. The push button 313 is recessed in the second contact face 305.

The first set of pins 310 and the second set of pins 312 are provided on first and second pin faces (not shown) respectively of the sliding element.

The sliding element 311 and the housing 301 are provided with blocking means (not shown). Furthermore, the plug 301 is provided with a stop bar (not shown), one end of which acts as the push button 313. The design and functioning of the blocking means and the stop bar can be comparable to those of the second embodiment, as shown in FIGS. 22-27. However, it is pointed out that instead of blocking balls, as shown by reference numerals 226 and 227 of FIGS. 22-27, it is also possible to use blocking lips, as shown and described in relation to the first embodiment, or a differently designed stopper which is movable between a stop position, in which the mutual movability of the blocking means is prevented, and a release position.

FIGS. 32-35 show a plug 400 according to a fourth embodiment of the invention. The plug 400 is intended for use as a mains plug, for non-earthed applications. The plug 400 comprises a housing 401 with a first contact face 402. The housing 401 is furthermore provided with a power cable 403. The housing 401 furthermore comprises a second contact face 405, which is provided substantially diametrically opposite the first contact face 402. The shape and dimensions of the first contact face 402 correspond to those of an non-earthed power point of a first type, in that case of the type usually found on the continent of Europe. The shape and dimensions of the second contact face 405 correspond to those of power points of a second type, in that case of the type usually found, for example, in the British Isles, including Ireland and Hong Kong.

The plug 400 is provided with a first set of pins 410 (FIG. 33), which is suitable for use in the first type of power point. The first set of pins 410 is provided on a double-sided sliding element (not shown). The sliding element is slidably accommodated in the housing 401, so that it can assume a first position (FIGS. 32 and 33) and a second position (FIGS. 34 and 35) as desired.

The plug furthermore comprises a second set of pins 412 (FIG. 34) and a push button 413. The push button 413 is recessed in the first contact face 402.

The second set of pins 412 comprises two live pins 460 and an opener 462. Since the plug 400 in the exemplary embodiment shown is provided for non-earthed power points, the opener 462 serves to unblock the power point concerned. The first set of pins 410 and the live pins 460 of the second set of pins 412 extend from respective pin faces (not shown) of the sliding element. The opener 462 in this exemplary embodiment is connected to the housing 401 in such a way that it is rotatable about an axis of rotation (not shown). Otherwise, in a variant on this fourth embodiment the opener 462 can also be connected to the sliding element, as shown in the second and third embodiments, or it could be permanently connected to the housing 401, in order to act as a sliding element, as shown in the first embodiment.

Blocking means and a stopper are accommodated in the housing 401, which stopper is connected to the push button 413. The blocking means and stopper are designed in a comparable manner to that shown in detail in relation to the first and/or second embodiment.

Electronics are also accommodated in the housing 401 of the plug 400, for transforming and/or rectifying an electric current which is introduced into the housing 402 by way of the first set of pins 410 or second set of pins 412. The electronics can furthermore comprise a control system for switching and/or metering a desired quantity of current, for example with a view to charging an electrical consumer appliance that has a battery. Examples of such electrical consumer appliances are mobile telephones, shavers, portable computers (hand-held or otherwise), navigation systems, portable audio equipment, video cameras, still cameras, and electrical equipment.

The electronics could also be suitable for directly charging a set of exchangeable, rechargeable batteries. The holder for accommodating the rechargeable batteries can be integral with the housing 401 of the plug 400, or it can be connected to said housing by means of the power cable 403.

In the case of direct charging of electrical appliances, the power cable 403 will generally end in a female-type plug, which can be connected to the electrical appliance concerned. Depending on the application concerned, the electronics do not necessarily have to comprise a control system for metering the charging current. Nor is it necessary in all cases to rectify the transformed current.

Within the scope of the invention a number of variants are possible for the parts shown. For instance, a plug with only one set of pins is possible, for a simple plug whose pins are telescopic. It is also possible for the plug to be provided with more than two sets of pins.

Furthermore, types of plugs other than mains plugs can be provided with pins with a blocking device according to the invention. Although the embodiments illustrated are in the form of a plug with a power cable, it is also possible to design the invention in the form of an adapter or travel plug. In that case one face of the housing is provided with plug-receiving means, or a power point for one or more types of plugs. Of course, electronics for transforming and/or rectifying current, such as described here in relation to the fourth embodiment, can also be present in differently designed plugs according to the invention. Other combinations of pins, and pins that are suitable for countries other than those described, are also possible.

Other blocking means are conceivable in addition to the blocking means shown, in the form of bevelled faces, blocking lips and blocking balls. It is pointed out here that the bevelled faces are bevelled in order to facilitate the movement of the blocking means away from each other when the stopper is in the release position. It is, however, also conceivable for the blocking means in the release position to move away from each other in another manner, for example by means of spring means. In that case the blocking faces need not be bevelled, and they can extend, for example, substantially in the radial direction.

The stoppers shown are for the most part integral with the stop bar in which they are provided. However, a stopper can also be provided in the form of, for example, a separate ring, or separate lugs, which are provided on a stop element. If several stoppers are provided in a blocking device, as illustrated, they need not be provided on the same stop element and thus be operable by means of one stop element and push button. The stoppers can also be located on individual elements and operated individually if desired.

One or more sets of pins can be movably connected to the housing in a way other than being slidably connected. For instance, it is conceivable for the set of pins to swing rotatably out of the housing.

The invention thus provides a plug with a set of slidable pins and a blocking device. The blocking device comprises a stopper which ensures greater reliability and is not so susceptible to wear. The plug can also be produced in a simple manner, with a relatively small number of parts. The necessary parts for the blocking device take up little space in the housing, owing to the fact that they extend partly in the sliding direction of the pins. The blocking of the pins which are pushed out into the active position and the pins which are in the housing can be performed partly by means of the same blocking device. This means that fewer different parts are required than is the case in the prior art.

What is claimed is:

1. A plug, comprising:

a housing with a first contact face, a first set of pins for a first type of power point, and a first blocking device, comprising interacting first and second blocking means, in which the first set of pins is slidably accommodated in the housing so as to assume an active or a passive position as desired, the first set of pins in the active position projecting from the first contact face of the housing in such a way that said set of pins can be inserted into the first type of power point, the first blocking means are connected to the first set of pins, the second blocking means are connected to the housing, and the first and second blocking means are movable relative to each other, so that they can assume a blocking position, in which the slidability of the first set of pins is blocked, and an unblocking position, in which the first set of pins is slidable, wherein the first blocking device furthermore comprises a first stopper, which first stopper is movable relative to the first and second blocking means between a stop position, in which the first stopper inhibits the movability of the first and second blocking means relative to each other, and a release position in which the first stopper does not inhibit the movability of the first and second blocking means relative to each other.

2. The plug according to claim 1, in which the first stopper is movable in a sliding direction of the first set of pins.

3. The plug according to claim 1, in which the second blocking means are intended to interact with the first blocking means to block the slidability of the first set of pins in the active position and the first blocking device furthermore comprises third blocking means connected to the housing, for interacting with the first blocking means to block the slidability of the first set of pins in the passive position.

4. The plug according to claim 3, in which the first blocking device furthermore comprises a second stopper, which second stopper is movable between a stop position, in which the movability of the first and third blocking means relative to each other is prevented, and a release position.

5. The plug according to claim 4, in which the first and second stoppers are permanently connected to each other.

6. The plug according to claim 1, furthermore comprising a second set of pins for a second type of plug.

7. The plug according to claim 6, furthermore comprising a double-sided sliding element, slidably accommodated in the housing, so that it can assume a first and a second position as desired, which double-sided sliding element comprises first pin faces and second pin faces, in which the second pin face is provided substantially diametrically opposite the first pin face, the first set of pins extends from the first pin face, and the second set of pins extends from the second pin face, the first set of pins in the first position projects from the first contact face of the housing in such a way that it can be inserted into the first type of power point, and the second set of pins in the second position projects from a second contact face of the housing in such a way that it can be inserted into the second type of power point.

8. The plug according to claim 6, in which the second set of pins comprises at least three pins, one of which pins is an opener for a fused power point, such as a British power point, and the first set of pins is provided on a sliding element which is provided so as to be slidable around the opener of the second set of pins.

9. The plug according to claim 8, in which the first blocking means are provided on the sliding element, the second blocking means are provided on the opener, the opener is permanently connected to the housing, and the stopper is provided in the opener.

10. The plug according to claim 6, furthermore comprising a second blocking device, which comprises interacting fourth blocking means and fifth blocking means, in which the second set of pins is slidably accommodated in the housing so as to assume an active or a passive position as desired, the second set of pins in the active position projecting from the housing in such a way that it can be inserted into the second type of power point, the fourth blocking means are connected to the second set of pins, the fifth blocking means are connected to the housing, and the fourth and fifth blocking means are movable relative to each other, so that they can assume a blocking position, in which the slidability of the second set of pins is blocked, and an unblocking position, in which the second set of pins is slidable, and in which the second blocking device furthermore comprises a third stopper, which third stopper is movable between a stop position, in which the movability of the fourth and fifth blocking means relative to each other is prevented, and a release position.

* * * * *